US006371028B2

(12) United States Patent
Saxby

(10) Patent No.: US 6,371,028 B2
(45) **Date of Patent: *Apr. 16, 2002**

(54) PROJECTILES

(76) Inventor: Michael Ernest Saxby, 82 Cowdray Park Road, Little Common, Bexhill-on-Sea, East Sussex TN39 4EZ (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/220,907

(22) Filed: Dec. 24, 1998

(30) Foreign Application Priority Data

Oct. 26, 1998 (GB) ..... 9823417

(51) Int. Cl.[7] ..... F42B 12/00
(52) U.S. Cl. ..... 102/502; 102/444; 102/529
(58) Field of Search ..... 102/502, 529, 102/400, 449, 456, 444

(56) References Cited

U.S. PATENT DOCUMENTS

| | | | | | |
|---|---|---|---|---|---|
| 3,477,375 | A | | 11/1969 | Barr | 102/45 |
| 3,528,662 | A | | 9/1970 | Merchant et al. | 273/106.5 |
| 3,782,286 | A | | 1/1974 | Jones et al. | 102/41 |
| 3,837,284 | A | | 9/1974 | Waldeisen | 102/92 |
| 3,865,038 | A | * | 2/1975 | Barr | 102/502 |
| 3,906,859 | A | | 9/1975 | Smith | 102/41 |
| 3,911,824 | A | * | 10/1975 | Barr et al. | 102/502 |
| 3,952,662 | A | | 4/1976 | Greenlees | 102/92.7 |
| 4,128,059 | A | | 12/1978 | Black | 102/92.7 |
| 4,204,474 | A | | 5/1980 | Mizelle | 102/92.7 |
| 4,637,616 | A | | 1/1987 | Whiting | 273/418 |
| 4,656,092 | A | * | 4/1987 | Haman et al. | 428/402.2 |
| 4,686,905 | A | | 8/1987 | Szabo | 102/444 |
| 4,823,702 | A | | 4/1989 | Woolsey | 102/502 |
| 4,899,660 | A | * | 2/1990 | Brighton | 102/447 |
| 4,947,752 | A | * | 8/1990 | Richert | 102/430 |
| 5,361,700 | A | * | 11/1994 | Carbone | 102/439 |
| 5,450,795 | A | * | 9/1995 | Adelman | 102/444 |
| 5,936,190 | A | * | 8/1999 | Buzick | 102/502 |

FOREIGN PATENT DOCUMENTS

| | | |
|---|---|---|
| DE | 8707244 | 9/1987 |
| EP | 0103509 | 3/1984 |
| FR | 2768504 | 3/1999 |
| GB | 1263522 | 2/1972 |
| GB | 1309362 | 3/1973 |
| GB | 1371482 | 10/1974 |
| GB | 2284252 A | 5/1995 |
| WO | WO 89/06681 | 7/1989 |
| WO | WO 91/14916 | 10/1991 |
| WO | WO 95/05573 | 2/1995 |

* cited by examiner

*Primary Examiner*—Peter M. Poon
*Assistant Examiner*—James Bergin
(74) *Attorney, Agent, or Firm*—Lahive & Cockfield, LLP

(57) ABSTRACT

The invention provides a combination of a gun having a barrel and a propellant for launching a projectile from the barrel; and a non-lethal projectile;

characterized in that the non-lethal projectile comprises a hollow outer casing formed from a resiliently deformable material, and a plurality of balls within the casing, the outer casing being deformed as it travels along the gun barrel under pressure from the propellant but being sufficiently resilient to resile to a substantially undeformed state upon leaving the gun barrel.

25 Claims, 2 Drawing Sheets

PROJECTILES

BACKGROUND OF THE INVENTION

This invention relates to a gun assembly and to projectiles of a non-lethal type, for example for use in riot control situations.

The need for projectiles that can be fired from guns with a reduced risk of lethal impact upon a human frame is well documented. Thus, baton rounds, or plastic bullets as they are commonly known, have long been used in civil disorder situations such as riots. The intention behind such baton rounds is to inflict pain and discomfort on rioters, thereby halting and/or deterring further rioting, but without causing serious injury to any person struck by the baton round.

However, the projectiles that have been developed and are currently used by police and military forces have been found to suffer from a number of significant problems. In particular, it has been found that current projectiles:

(a) cause serious injury when used incorrectly;

(b) are inaccurate;

(c) are expensive for training; and (d) cause secondary injuries from sharp edges and ricochets.

SUMMARY OF THE INVENTION

It is an object of the present invention to overcome the aforementioned problems.

Accordingly, in a first aspect, the invention provides a combination of a gun having a barrel; propellant means for launching a projectile from the barrel; and a non-lethal projectile;

characterised in that the non-lethal projectile comprises a hollow outer casing formed from a resiliently deformable material, and a plurality of balls within the casing, the outer casing being deformed as it travels along the gun barrel under pressure from the propellant means but being sufficiently resilient to resile to a substantially undeformed state upon leaving the gun barrel.

In a further aspect, the invention provides a projectile for use in a gun as hereinbefore defined, the projectile comprising a hollow outer casing formed from a resiliently deformable material, the outer casing containing a plurality of balls, the outer casing being deformable as it travels along the gun barrel under pressure from the propellant means but being sufficiently resilient to resile to a substantially undeformed state upon leaving the gun barrel.

In a still further aspect, the invention provides a projectile comprising a hollow outer casing formed from a resiliently deformable material, the outer casing containing a plurality of balls, the outer casing being deformable when contacted by propulsion means but being sufficiently resilient to resile to a substantially undeformed state in flight.

Preferably, lubrication means are provided for reducing friction between the outer casing and the barrel as the projectile travels along the barrel.

It is important that the projectile is shaped so as to be free of any sharp edges and protrusions that might cause injury and hence preferably the outer casing of the projectile is spherical. As an alternative, for example with smaller projectiles, it could have a teardrop shape. The spherical shape of the outer casing also has good ballistic characteristics allowing good accuracy to be achieved.

Similarly, the balls within the casing are free from sharp edges and most preferably are of substantially spherical form. The surfaces of the balls are smooth so as to allow one ball to slide readily over the surface of another. This is important because the ability of the balls to be redistributed in the outer casing rapidly upon impact with a target will determine the extent to which the energy of impact of the bullet is absorbed by the projectile rather than the target.

The outer casing is resiliently deformable and, when the gun is fired, the outer casing deforms under the pressure of the propellant means, but the shape of the projectile ensures that the center of mass of the deformed projectile remains centered on the axis of the gun barrel. The projectile is sufficiently resilient to enable it to regain a substantially spherical shape upon exit from the gun barrel thereby ensuring greater accuracy.

The outer casing is preferably formed from an elastomeric material, for example a natural or synthetic rubber. The elastomeric material typically has a Shore hardness in the range from 40 to 80, more typically in the range from 45 to 55.

The balls within the outer casing typically have a maximum dimension (e.g. diameter) in the range from 2 mm to 10 mm, preferably from 2.5 mm to 6 mm. The number of balls within the outer casing will vary according to the size of the balls and the overall size and weight of the projectile but, for example, the casing can contain from 150 to 250 balls.

The balls are usually formed from a material having a density greater than the resiliently deformable material from which the outer casing is formed. In general, the minimum density of the balls is equivalent to a specific gravity of 7.0. For example, the balls can be formed from a metal such as steel. In one embodiment, the balls can take the form of steel ball bearings, although it is not necessary for the balls to have same polished surface finish as ball bearings.

The balls are relatively hard compared to the outer casing and typically the minimum hardness of the balls is 106 Brunel Units which corresponds to a Rockwell hardness of 90.5. Thus, the balls should preferably have a hardness at least as great as mild steel. It has been found that when the balls are made of a softer metal such as lead or brass, the balls have a tendency to fuse together upon impact, which could have potentially lethal results.

The overall weight of the projectile, including the casing and the balls, is usually in the range from 60 to 150 grammes, for example from 75 to 125 grammes.

The casing is made from a material which is sufficiently tough and thick to ensure that it does not rupture during firing or during normal impact on a target. Thus, for example, the outer casing typically has a thickness in the range from 2 mm to 8 mm, more usually 3 mm to 5 mm.

In another aspect, the invention provides a cartridge comprising a cartridge casing, a propellant and a projectile as hereinbefore defined.

In a particular embodiment, the cartridge casing can contain a piston which is slidably disposed in the cartridge casing behind the projectile so as to eject the projectile therefrom when the gun is fired.

The cartridge casing preferably contains means (e.g. lubrication means) for reducing friction between the outer casing of the projectile and the barrel as the projectile travels along the barrel.

The projectile is preferably disposed within a cylindrical sleeve forwardly of the piston, the cylindrical sleeve being formed from a low friction material and being arranged to be ejected from the gun barrel with the piston and projectile when the gun is fired, the projectile becoming separated from the sleeve after emergence from the gun barrel.

The sleeve can be formed from, for example, a paper or a low friction material such as PTFE.

The sleeve serves to prevent the projectile from coming into contact with the cartridge case or the barrel, at least for a substantial proportion of the distance of travel of the projectile down the gun barrel. The sleeve provides a low and relatively constant friction level between the projectile and the gun barrel and prevents any drag that might otherwise arise from a relatively high friction material such as a rubber. Alternatively, however, the outer casing of the projectile can be formed from a relatively low friction material (e.g. PTFE), or can be treated with a friction reducing substance such as PTFE.

BRIEF DESCRIPTION OF THE DRAWINGS

The invention will now be illustrated, but not limited, by reference to the accompanying drawings of which.

DESCRIPTION OF THE PREFERRED EMBODIMENT

Figure 1:
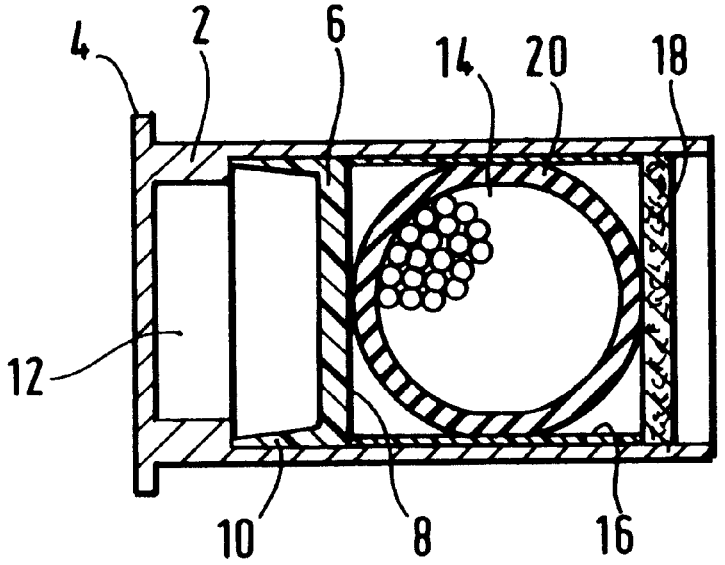
FIG. 1 is a side sectional elevation of a cartridge according to one embodiment of the invention.

Referring now to the drawings, a cartridge according to the invention comprises a cartridge case 2 of hollow generally cylindrical form for engaging in the breach of a gun. In this embodiment, the case 2 is shown as having a peripheral flange 4 at its rear end, but it need not be flange-ended and could be of any shape suitable for engaging in the breach of the gun. Slidably disposed within the case 2 is a piston or "sabot" 6 which is formed of a suitable plastics material such as low density polyethylene and has a forward disc portion 8 and a trailing skirt 10 which tapers in a rearwards direction.

Located behind the sabot 6 is either a compressed gas charge or a primer and propellant 12 which may be of conventional type.

Located in front of the sabot 6 is a projectile 14 which is wrapped in a cylindrical sleeve 16 formed from a low friction material which can be, for example, paper or PTFE. The front end of the cartridge is plugged by a wad of fibrous material which serves to prevent dirt and other contaminants from entering the cartridge during storage.

Figure 3:
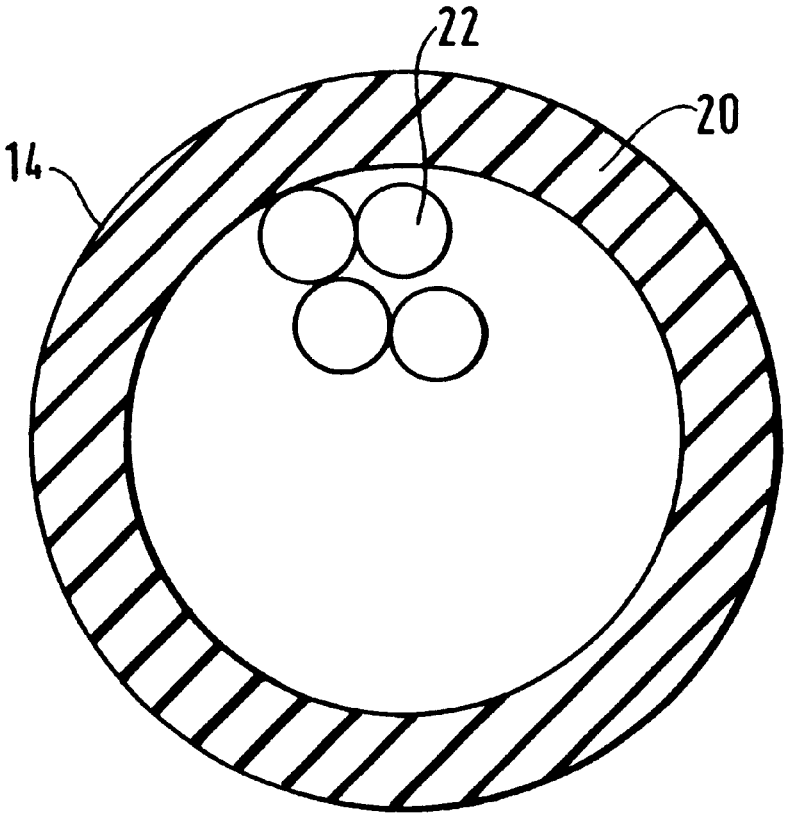
FIG. 3 is an enlarged sectional elevation of the projectile shown in FIGS. 1 and 2.
Figure 2:
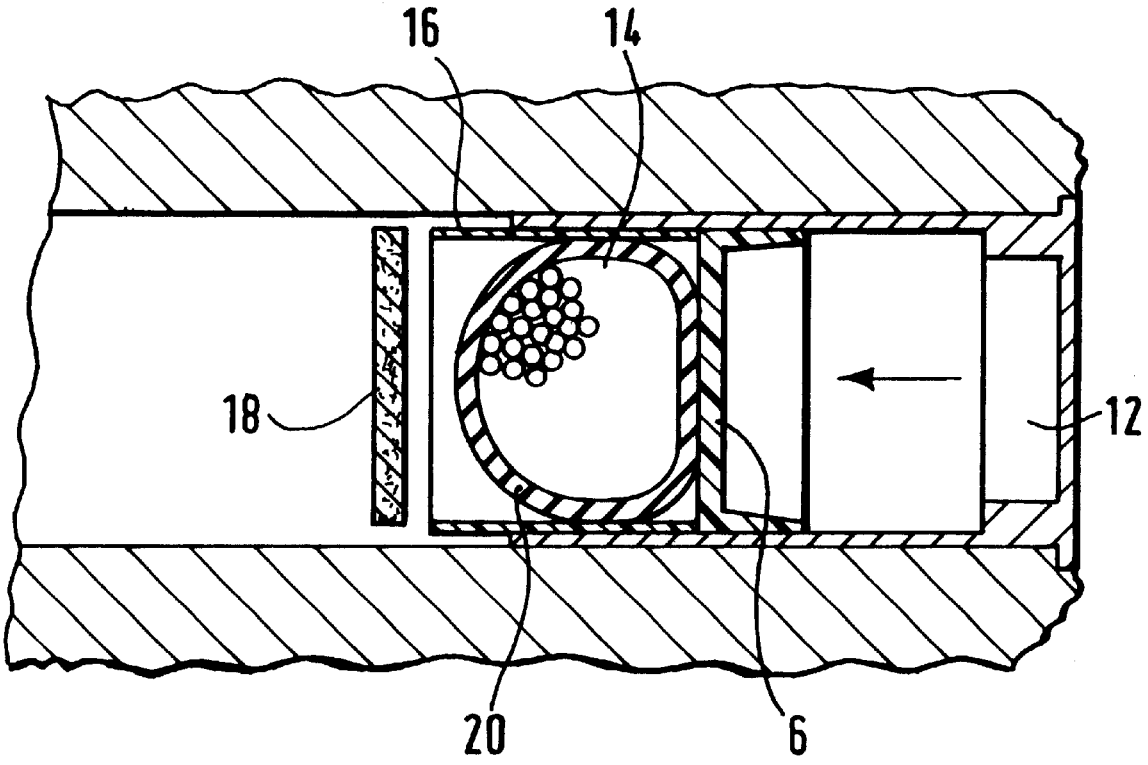
FIG. 2 is a sectional view of the cartridge of FIG. 1 positioned within a gun barrel, the cartridge having just been detonated.

The projectile, which is shown in enlarged form in FIG. 3, comprises a hollow outer casing 20 formed from a natural or synthetic rubber material, the casing containing a plurality of spherical balls 22 which in this embodiment are formed from steel, although other relatively hard materials could be used instead. The synthetic rubber material in this embodiment has a Shore hardness of from 45 to 55 and the wall of the outer casing has a thickness of about 3 mm to 5 mm. The diameter of the outer casing can vary according to the calibre of the round, but can be for example of 40 mm in diameter. The steel balls, of which there are typically of the order of about 200, are of 2.5 mm to 6 mm in diameter, preferably of uniform size, and the overall weight of the projectile is about 75 to 125 grammes.

When the gun is fired, the expanding propellant gases drive the sabot 6 along the cartridge case and the barrel, the sabot in turn expelling the sleeve 16, projectile 14 and wad 18 from the cartridge case and driving them along the barrel. As the projectile is impacted by the sabot and is driven along the barrel, it is deformed such that it becomes flatter in an axial direction, the radial periphery of the outer casing being urged outwardly against the sleeve 16 thereby preventing the expanding propellant gases from escaping around the sides of the projectile. The sleeve serves to reduce friction between the projectile and the cartridge case or the barrel. Once the sleeve, projectile, wad and sabot emerge from the gun barrel, the relatively low momentum of the wad, sleeve and sabot mean that they rapidly fall away whilst the projectile continues towards the target.

When the projectile impacts against the target, the resilient rubber outer casing is flattened against the target by the hard balls within the casing which serve to spread the impact area. At relatively close range, the projectile has high velocity and therefore more kinetic energy and, as a result, flattens more on impact thereby preventing penetration of the target and consequent injury. At longer range, where the projectile has less kinetic energy upon impact with the target, the outer casing does not flatten as much. The result of the form of construction of the projectile is that the risk of injury at close range is greatly reduced but the projectile is nevertheless accurate and effective over longer ranges. In particular, the risk of fatal injury is greatly reduced at distances of over about 2 meters (6 feet) by means of the projectiles of the invention.

By using different sabots and differently sized wads, a single size of projectile can be used for both 37 mm, 1.5 inch and 40 mm guns, thereby enabling a standard baton round to be used by police and military forces for a wide variety of different guns.

It will readily be apparent that numerous modifications and alterations could be made to the specific embodiments shown in the drawings without departing from the principles underlying the invention, and all such modifications and alterations are intended to be embraced by this application.

What is claimed is:

1. A combination of a gun having a barrel and propellant means for launching a projectile from the barrel; and a non-lethal projectile;

characterised in that the non-lethal projectile comprises a hollow spherical outer casing formed from a resiliently deformable material, and a plurality of substantially spherical balls within the casing, the spherical outer casing being deformed as it travels along the gun barrel under pressure from the propellant means but being sufficiently resilient to resile to a substantially undeformed state upon leaving the gun barrel, wherein the substantially spherical balls are formed from a material having a density greater than the resiliently deformable material from which the spherical outer casing is formed, and said spherical balls have a maximum diameter in the range from 2 mm to 10 mm, a minimum density equivalent to a specific gravity of 7.0, and a minimum Rockwell hardness of 90.5, and wherein the plurality of substantially spherical balls have surfaces that are smooth so as to allow one ball to slide readily over the surface of another.

2. A projectile for use in a gun, the gun having a barrel and propellant means for lanuching the projectile from the barrel; the projectile comprising a spherical hollow outer casing formed from a resiliently deformable material, the spherical outer casing containing a plurality of substantially spherical balls, the outer casing being deformable as it travels along the gun barrel under pressure from the propellant means but being sufficiently resilient to resile to a substantially undeformed state upon leaving the gun barrel, wherein the substantially spherical balls are formed from a material having a density greater than the resiliently deformable material from which the spherical outer casing is formed, and said spherical balls have a maximum diameter in the range from 2 mm to 10 mm, a minimum density equivalent to a specific gravity of 7.0, and a minimum Rockwell hardness of 90.5, and wherein the plurality of substantially spherical balls have surfaces that are smooth so as to allow one ball to slide readily over the surface of another.

3. A projectile according to claim 2 wherein the maximum diameter of the balls is in the range from 2.5 mm to 6 mm.

4. A projectile according to claim 2 wherein the spherical outer casing contains from 150 to 250 balls.

5. A projectile according to claim 2 wherein the balls are formed from a metal.

6. A projectile according to claim 5 wherein the metal is steel.

7. A projectile according to claim 2 wherein the spherical outer casing is formed from an elastomeric material.

8. A projectile according to claim 7 wherein the elastomeric material is a natural or synthetic rubber.

9. A projectile according to claim 7 wherein the elastomeric material has a Shore hardness in the range from 40 to 80.

10. A projectile according to claim 9 wherein the Shore hardness of the elastomeric material is in the range from 45 to 55.

11. A projectile according to claim 2 wherein the projectile has a weight in the range from 60 to 150 grammes.

12. A projectile according to claim 11 wherein the projectile has a weight in the range from 75 to 125 grammes.

13. A projectile according to claim 2 where the spherical outer casing has a thickness in the range from 2 mm to 8 mm.

14. A projectile according to claim 13, wherein the spherical outer casing has a thickness in the range from 3 mm to 5 mm.

15. A projectile as defined in claim 2 which is provided with lubricant means for reducing friction between the spherical outer casing and a barrel as the projectile travels along the barrel.

16. A projectile according to claim 15 wherein the lubrication means takes the form of a sleeve of a low friction material surrounding the projectile, the sleeve being separable from the projectile after emergence from the gun barrel after firing.

17. A cartridge comprising a cartridge casing, a propellant and a projectile; the projectile comprising a spherical hollow outer casing formed from a resiliently deformable material, the spherical outer casing containing a plurality of substantially spherical balls, the outer casing being deformable as it travels along the gun barrel under pressure from the propellant means but being sufficiently resilient to resile to a substantially undeformed state upon leaving the gun barrel, wherein the substantially spherical balls are formed from a material having a density greater than the resiliently deformable material from which the spherical outer casing is formed, and said spherical balls have a maximum diameter in the range from 2 mm to 10 mm, a minimum density equivalent to a specific gravity of 7.0, and a minimum Rockwell hardness of 90.5, and wherein the plurality of substantially spherical balls have surfaces that are smooth so as to allow one ball to slide readily over the surface of another.

18. A cartridge according to claim 17 having a piston being slidably disposed in the cartridge casing behind the projectile so as to eject the projectile therefrom when the gun is fired.

19. A cartridge according to claim 18 wherein the projectile is disposed within a cylindrical sleeve forwardly of the piston, the cylindrical sleeve being formed from a low friction material and being arranged to be ejected from the gun barrel with the piston and projectile when the gun is fired, the projectile becoming separated from the sleeve before or after emergence from the gun barrel.

20. A cartridge according to claim 19 wherein the sleeve is formed from a paper or PTFE.

21. A cartridge according to claim 18 wherein the piston is formed from a plastics material.

22. A cartridge according to claim 18 which is closed at its forward end by a plug.

23. A projectile according to claim 22 wherein the plug is a wad of fibrous material.

24. A projectile comprising a spherical hollow outer casing from a resiliently deformable material, the spherical outer casing containing a plurality of substantially spherical balls, the spherical outer casing being deformable when contacted by propulsion means but being sufficiently resilient to resile to a substantially undeformed state in flight, wherein the substantially spherical balls are formed from a material having a density greater than the resiliently deformable material from which the spherical outer casing is formed, and said spherical balls have a maximum diameter in the range from 2 mm to 10 mm, a minimum density equivalent to a specific gravity of 7.0, and a minimum Rockwell hardness of 90.5, and wherein the plurality of substantially spherical balls have surfaces that are smooth so as to allow one ball to slide readily over the surface of another.

25. A combination of a gun having a barrel and propellant means for launching a projectile from the barrel; and a cartridge comprising a cartridge casing, a propellant and a projectile; the projectile comprising a spherical hollow outer casing formed from a resiliently deformable material, the outer casing containing a plurality of substantially spherical balls, the spherical outer casing being deformable as it travels along the gun barrel under pressure from the propellant means but being sufficiently resilient to resile to a substantially undeformed state upon leaving the gun barrel, wherein the substantially spherical balls are formed from a material having a density greater than the resiliently deformable material from which the spherical outer casing is formed, and said spherical balls have a maximum diameter in the range from 2 mm to 10 mm, a minimum density equivalent to a specific gravity of 7.0, and a minimum Rockwell hardness of 90.5, and wherein the plurality of substantially spherical balls have surfaces that are smooth so as to allow one ball to slide readily over the surface of another.

* * * * *